US006019407A

United States Patent [19]

Ohman et al.

[11] Patent Number: 6,019,407

[45] Date of Patent: Feb. 1, 2000

[54] SYNTHETIC WEB FITTING

[75] Inventors: Roger A. Ohman, Tierra Verde, Fla.; Charles Ron Garrett, Ramona; Roger E. Beall, Mounds, both of Okla.

[73] Assignee: The Crosby Group, Inc., Tulsa, Okla.

[21] Appl. No.: 09/236,781

[22] Filed: Jan. 25, 1999

[51] Int. Cl.[7] ..... B66C 1/12

[52] U.S. Cl. ..... 294/82.14; 294/74; 24/199

[58] Field of Search ..... 294/74, 82.1, 82.11, 294/82.14; 24/197, 198, 199, 200, 265 R, 265 AL, 265 H, 265 EC, 265 BC

[56] References Cited

U.S. PATENT DOCUMENTS

| | | | |
|---|---|---|---|
| 251,996 | 1/1882 | Callahan | 294/82.14 |
| 909,782 | 1/1909 | Gibson . | |
| 2,449,300 | 9/1948 | Jones | 24/200 |
| 3,352,590 | 11/1967 | Barthule | 294/74 |
| 3,583,750 | 6/1971 | Norton | 294/74 |
| 4,193,627 | 3/1980 | Cranston et al. | 294/82 |
| 4,493,135 | 1/1985 | Crook, Jr. | 24/200 |
| 4,993,769 | 2/1991 | Chapalain | 294/74 |
| 5,123,690 | 6/1992 | Bailey | 294/74 |
| 5,419,951 | 5/1995 | Golz | 428/229 |
| 5,566,428 | 10/1996 | Takahashi | 24/265 |
| 5,660,423 | 8/1997 | Herman et al. | 294/74 |
| 5,683,131 | 11/1997 | Lucas | 294/74 |

FOREIGN PATENT DOCUMENTS

| | | | |
|---|---|---|---|
| 2647-098 | 11/1990 | France | 294/74 |

OTHER PUBLICATIONS

The Crosby Group, Inc.; Sling Saver, Accessories for Web Slings and Round Slings, 1998.

*Primary Examiner*—Dean J. Kramer
*Attorney, Agent, or Firm*—Head, Johnson & Kachigian

[57] ABSTRACT

A fitting for a synthetic web sling. In one preferred embodiment, the fitting includes a spool for receiving the synthetic web sling. A hook is opposed to the spool, the hook having a width and having a saddle for receiving the synthetic web sling therein. The saddle includes an arcuate surface with an expanded diameter larger than the width of the hook. The saddle also includes a central raised portion. A pair of opposed frusto-conical bumpers are axially aligned with the saddle to laterally align the web sling on the saddle.

5 Claims, 3 Drawing Sheets

SYNTHETIC WEB FITTING

BACKGROUND OF THE INVENTION

1. Field of the Invention

The present invention is directed to a fitting for a synthetic web sling for use in lifting and hoisting. In particular, the invention relates to a fitting for a synthetic web sling which will advantageously distribute the load from the web sling to the fitting, protect the web sling from abrasion, align the web sling laterally and prevent the sling from movement.

2. Prior Art

Slings that are made of fabric, such as nylon or polyester, are known to be advantageous in lifting products that may be damaged if lifted with a wire rope. These web slings are known to have excellent load limits while being relatively lightweight and durable.

It is known that increasing the radius or diameter of the sling bearing surface will result in an increased area for load distribution and will increase the efficiency of the fitting.

Folding, bunching or pinching of the synthetic web sling may occur when used with a hook, a shackle or other fittings. The folding, bunching or pinching of the synthetic web sling reduces the rated working load. Accordingly, the web sling should not be constricted or bunched in a hook or between the ears of a shackle or a clevis.

It is also known that the synthetic web sling should be protected from being cut by sharp corners, sharp edges, protrusions or abrasive surfaces. Use of slings which are dragged on the floor or over an abrasive surface should be minimized.

Accordingly, it is a principal object and purpose of the present invention to provide a synthetic web fitting which will distribute the load optimally from the web sling to the fitting.

It is a further object and purpose of the present invention to provide a synthetic web sling fitting with a mechanism to laterally align the web sling in the fitting and to minimize lateral or sliding movement.

It is a further object and purpose of the present invention to provide a synthetic web fitting that will protect the web sling from abrasion in the event the fitting and web sling are dragged on a floor or over an abrasive surface.

SUMMARY OF THE INVENTION

The present invention provides a fitting for a synthetic web sling. In one, preferred embodiment, the fitting would be used as a web sling to choker hook. On one end of the fitting is a spool which would receive one end of the web sling thereon. The spool includes an enlarged diameter to distribute the load and reduce sling wear. A shaft passes through the spool and is secured to a pair of legs that extend from one end of the fitting. The spool may also include a plastic cover to protect the web fabric from abrasion and cutting.

On the opposite, opposed end of the fitting from the spool is a hook having an opening for insertion of the fabric web sling. The hook includes an elongated saddle which is long enough to receive the web sling without any bunching or constriction.

The hook has a given width. The saddle includes an arcuate surface with an expanded diameter larger than the width of the hook. Accordingly, the sling bearing surface of the saddle has an increased area. The saddle is elongated with the diameter of the saddle tapering slightly from the smallest diameter at the ends to a larger diameter at the center resulting in a central raised portion.

On each end of the saddle is a frusto-conical bumper pad forming a pair of opposed bumper pads, each of which is axially aligned with the saddle. Each bumper pad extends from a small diameter connected to the saddle to a larger diameter. The large diameters of the frusto-conical bumper pads are greater than the diameter of the arcuate surface of the saddle. The difference between the large diameters of the frusto-conical bumper pads and the diameter of the arcuate surface of the saddle is greater than the thickness of the web sling.

Accordingly, if the web sling and fitting is dragged across a surface, such as the floor, or comes into contact with abrasive or other material, the bumper pads will protect the synthetic fabric web from contact or abrasion. Additionally, the frusto-conical bumper pads assist in seating the synthetic fabric web on the saddle and also act to retain the fabric web in position with minimal lateral movement during use.

Other preferred embodiments of the fitting for a synthetic web sling include a web sling spool to web shackle embodiment and a terminal end hook to web sling eye embodiment.

BRIEF DESCRIPTION OF THE DRAWINGS

FIG. 5 shows one end view while

FIG. 7 illustrates a sectional view taken along section line 7—7 of FIG. 4, while

DETAILED DESCRIPTION OF THE PREFERRED EMBODIMENTS

Figure 1:
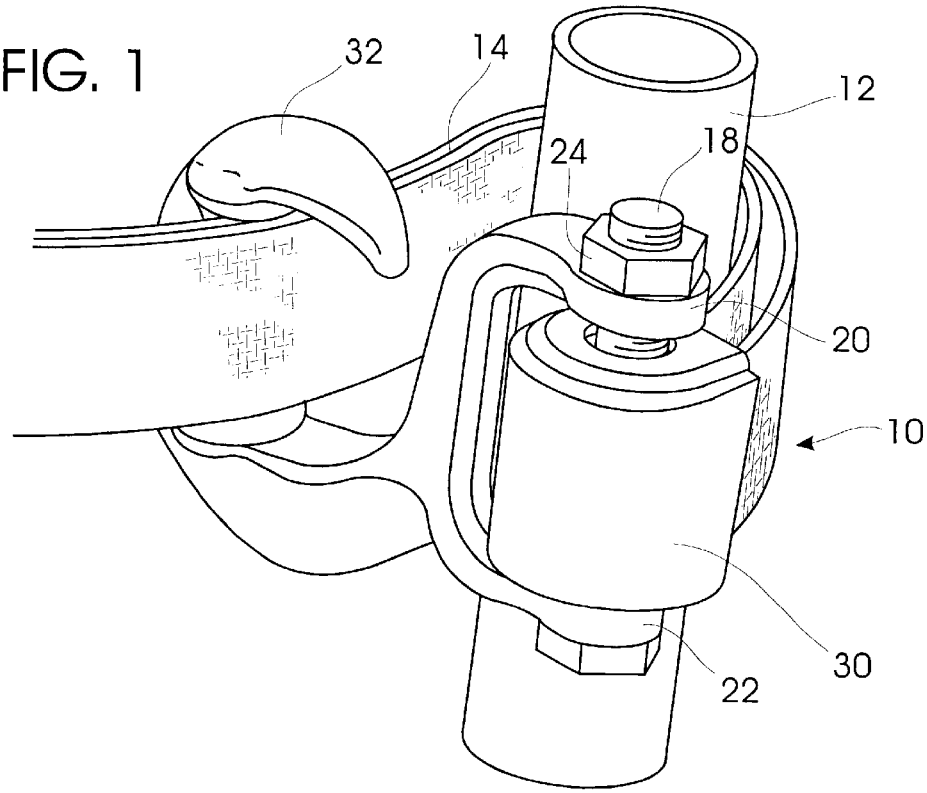
FIG. 1 illustrates a first, preferred embodiment of a fitting for a web sling wherein a web sling to choker hook fitting is engaged with a tubular pipe.

Referring to the drawings in detail, FIG. 1 illustrates a first, preferred embodiment of a fitting 10 for a web sling. FIG. 1 illustrates the fitting 10 in use as a web sling to choker hook. The fitting is shown engaged with a tubular pipe 12. A web sling 14 is made of a web-type fabric such as polyester or other synthetic or non-synthetic material.

Figure 2:
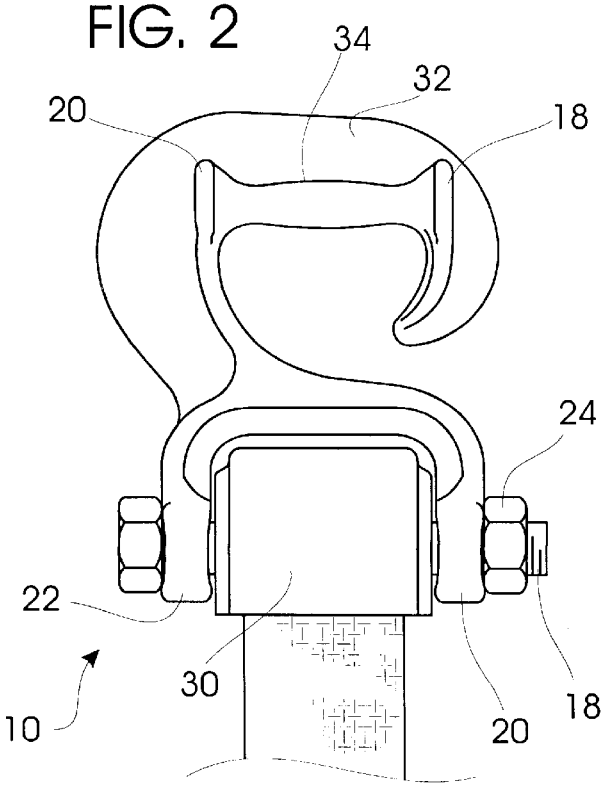
FIG. 2 illustrates a front view of the fitting shown in FIG. 1.
Figure 3:
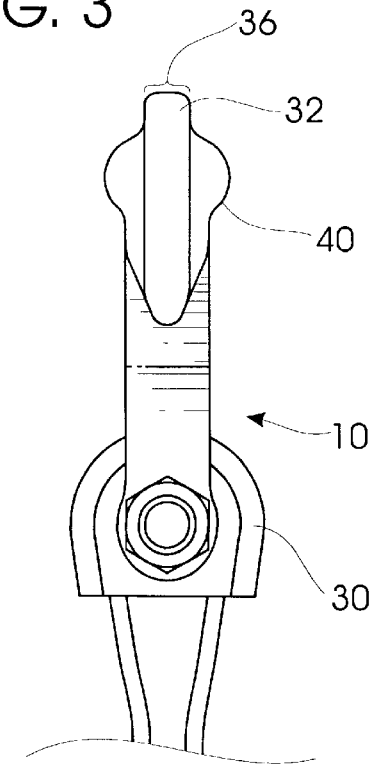
FIG. 3 illustrates a side view of the fitting shown in FIG. 2 apart from engagement with the tubular pipe.

FIG. 2 illustrates a front view of the fitting 10 while FIG. 3 illustrates a side view of the fitting 10 apart from engagement with the tubular pipe 12.

On one end of the fitting 10 is a spool which would receive the one end of the web sling thereon (the spool not visible in FIGS. 1, 2 and 3). The spool includes an enlarged diameter to distribute load and reduce sling wear.

A shaft 18 passes through the spool and is secured to a pair of legs 20 and 22 that extend from one end of the fitting. At least one end of the shaft 18 has external threads to receive a lock nut 24.

The spool may also include a plastic cover 30 to protect the web fabric 14 from abrasion and cutting.

On the opposite, opposed end of the fitting 10 from the spool is a hook 32 having an opening for insertion of the web sling 14. FIG. 1 shows the web sling installed through the hook. The hook 32 includes an elongated saddle 34, as best seen in FIG. 2. The saddle is long enough to receive the web sling without bunching or constriction.

As seen in FIG. 3, the hook 32 has a given width 36. The saddle 34 has an arcuate surface with an expanded diameter larger than the width of the hook 32. Accordingly, the sling bearing surface of the saddle has an increased area.

Figure 4:
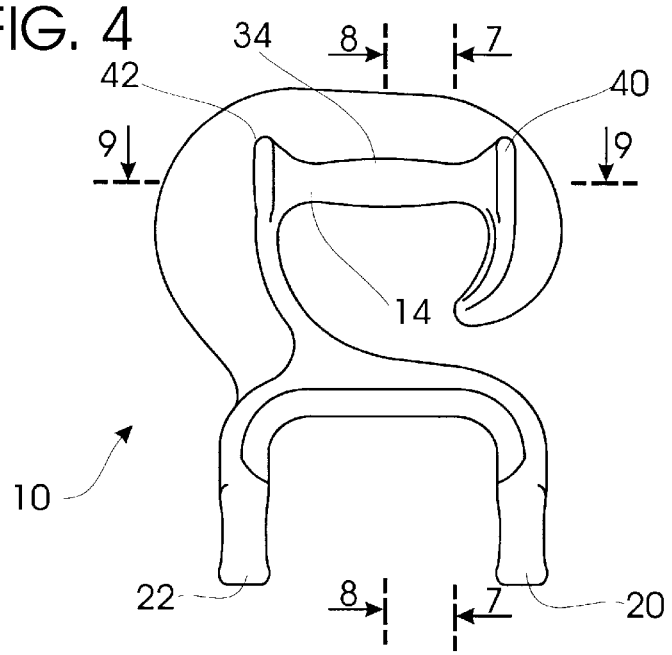
FIG. 4 is a front view of the fitting shown in FIG. 1 with spool and shaft removed for ease of viewing.
Figure 5:
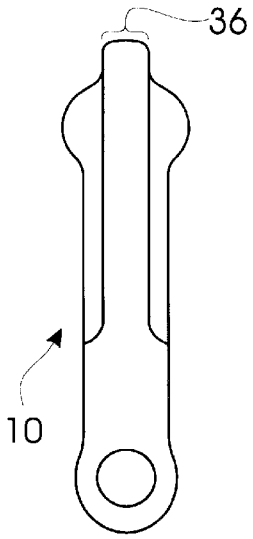
Figure 6:
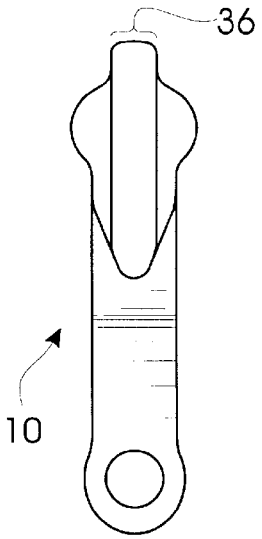
FIG. 6 shows the other end view of the fitting shown in FIG. 4.

FIG. 4 illustrates the fitting 10 with the spool and shaft 18 removed for ease of viewing. FIGS. 5 and 6 illustrate end views of the fitting as seen in FIG. 4. The saddle 34 is elongated with the diameter of the saddle tapering slightly from the smallest diameter at the ends to a larger diameter at the center resulting in a central raised portion. The sectional views seen in FIGS. 7 and 8 reveal the change in diameter. The central raised portion provides optimum load distribution.

On each end of the saddle 34 is a frusto-conical bumper pad forming a pair of opposed bumper pads 40 and 42. Each bumper pad extends from a small diameter connected to the saddle to a larger diameter.

Figure 7:
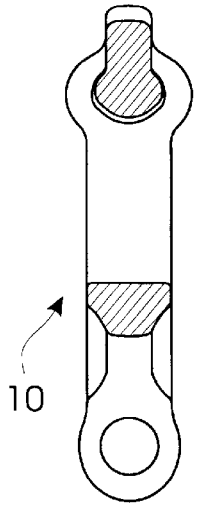
Figure 8:
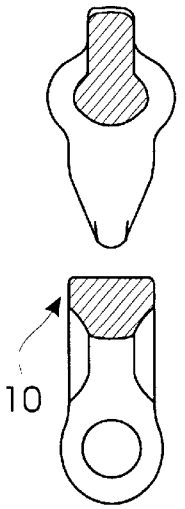
FIG. 8 shows a sectional view taken along section line 8—8 of FIG. 4.

FIG. 5 shows one end view and FIG. 6 shows the other end view of the fitting from FIG. 4. FIG. 7 illustrates a sectional view through one portion of the saddle 34 at section line 7—7 while FIG. 8 shows a sectional view through another portion of the saddle at section line 8—8. The frusto-conical bumper pads 40 and 42 have large diameters larger than the diameter of the arcuate surface of the saddle. The difference between the large diameters of the frusto-conical bumper pads and the diameter of the arcuate surface of the saddle is greater than the thickness of the web sling 14.

Accordingly, if the web sling 14 and fitting 10 is dragged across a surface, such as a floor, or if it comes into contact with abrasive or other material, the bumper pads 40 and 42 will protect the fabric web from contact or abrasion.

Additionally, the frusto-conical bumper pads 40 and 42 assist in seating the fabric web on the saddle and also act to retain the fabric web in position with minimal lateral movement during use.

Figure 9:
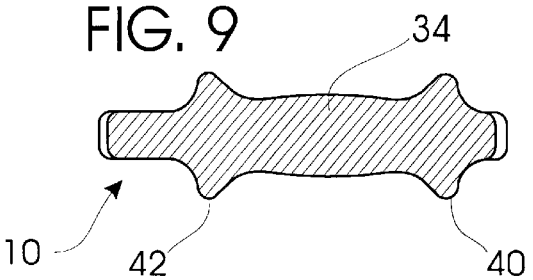
FIG. 9 shows a sectional view taken along section line 9—9 of FIG. 4.

FIG. 9 is a sectional view taken along section line 9—9 of FIG. 4 showing the diameters of the saddle and bumper pads.

Figure 10:
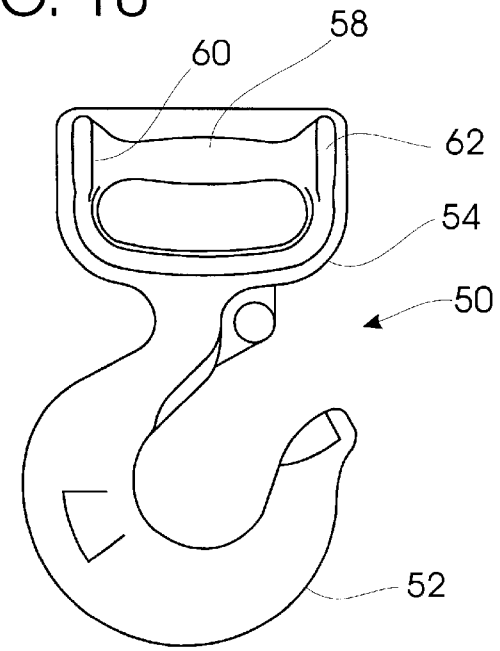
FIG. 10 illustrates a second, preferred embodiment of a fitting for a web sling illustrating a terminal end to eye connection.
Figure 11:
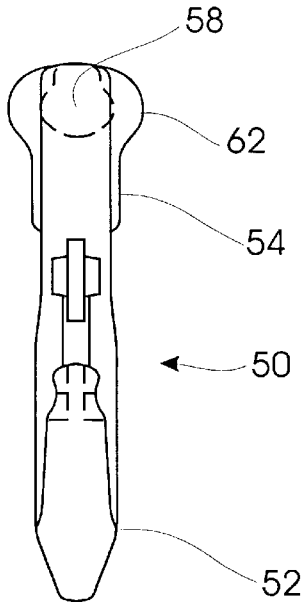
FIG. 11 is an end view of the fitting shown in FIG. 10.

FIGS. 10 and 11 illustrate a second, preferred embodiment of a fitting 50 for a web sling. FIGS. 10 and 11 illustrate the fitting 50 apart from the fabric web sling.

On one end of the fitting is a hook 52 for connecting to a terminal end or other fitting (not shown). An eye 54 is opposed to the hook. The eye has a width, thus seen in FIG. 11. The eye also includes a saddle 58 for receiving the synthetic web sling therein. The saddle includes an arcuate surface with an expanded diameter larger than the width of the eye.

As best seen in FIG. 10, the saddle also includes a central raised portion. Accordingly, the sling bearing surface of the saddle has an increased area. The saddle 58 is elongated with the diameter of the saddle tapering slightly from the smallest diameter at the ends to a slightly larger diameter at the center resulting in the central raised portion.

At each end of the saddle 58 is a frusto-conical bumper pad forming a pair of opposed bumper pads 60 and 62. The frusto-conical bumper pads 60 and 62 have large diameters which are greater than the diameter of the arcuate surface of the saddle. The difference between the large diameters of the frusto-conical bumper pads 60 and 62 and the diameter of the arcuate surface of the saddle is greater than the thickness of the web sling. Accordingly, if the fitting and web sling is dragged across a surface, such as a floor, or if it comes into contact with abrasive or other material, the bumper pads 60 and 62 will protect the synthetic fabric web from contact or abrasion.

Additionally, frusto-conical bumper pads 60 and 62 assist in seating the web sling on the saddle and also act to retain the fabric web in position with minimal lateral movement during use.

FIGS. 12, 13, 14 and 15 illustrate a third, preferred embodiment of a fitting 70 for a web sling. The fitting illustrated in FIGS. 12, 13, 14 and 15 a web shackle fitting.

FIGS. 12, 13, 14 and 15 are shown with the web sling removed and having a screw pin for attaching the web shackle to a lifting lug or other connection point. Other attachment devices may be a round pin or a bolt and nut.

Figure 12:
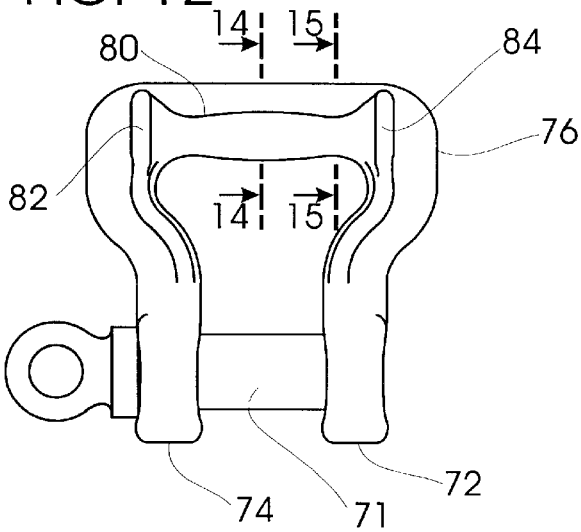
FIG. 12 is a front view of a third, preferred embodiment of a fitting for a web sling illustrating a web sling spool to web sling shackle embodiment.
Figure 13:
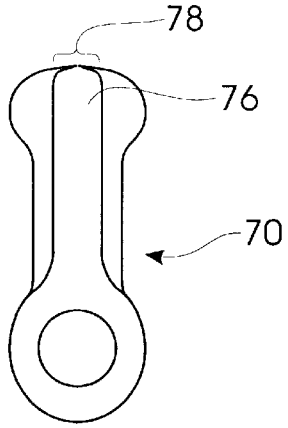
FIG. 13 is a side view of the fitting shown in FIG. 12.
Figure 14:
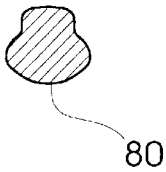
FIG. 14 is a sectional view taken along section line 14—14 of FIG. 12.
Figure 15:
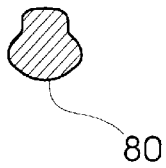
FIG. 15 is a sectional view taken along section line 15—15 of FIG. 12.

A screw pin 71 would extend between a pair of legs 72 and 74. On the opposite, opposed end of the screw pin 71 is a shackle bow 76 having a given width 78. The shackle includes an elongated saddle 80 as best seen in FIG. 12. The saddle 80 has an arcuate surface with an expanded diameter larger than the width 78 of the shackle 76.

The saddle is elongated with the diameter of the saddle tapering slightly from the smallest diameter at the ends to a larger diameter at the center resulting in a central raised portion. The sectional views of the saddle shown in FIGS. 14 and 15 reveal the slight change in diameter. The central raised portion provides optimum load distribution of the web sling to the saddle. On each end of the saddle 80 is a frusto-conical bumper pad forming a pair of opposed frusto-conical bumper pads 82 and 84. Each bumper pad extends from a small diameter connected to the saddle 80 to a larger diameter. The large diameters of the frusto-conical bumper pads 82 and 84 are greater than the diameter of the arcuate surface of the saddle. The difference between the large diameters of the frusto-conical bumper pads and the diameter of the arcuate surface of the saddle is greater than the thickness of the web sling.

Accordingly, if the web sling and end fitting 70 is dragged across a surface or comes into contact with abrasive or other material, the bumper pads 82 and 84 protect the synthetic fabric web from contact or abrasion.

Additionally, the frusto-conical bumper pads 82 and 84 assist in seating the synthetic fabric web on the saddle 80 and also act to retain the fabric web in position with minimal lateral movement during use.

Whereas, the present invention has been described in relation to the drawings attached hereto, it should be understood that other and further modifications, apart from those shown or suggested herein, may be made within the spirit and scope of this invention.

What is claimed is:

1. A fitting for a synthetic web sling, which fitting comprises:

a spool for receiving said synthetic web sling;

a hook opposed to said spool, said hook having a width and having a saddle for receiving said synthetic web sling therein, said saddle having an arcuate surface with an expanded diameter larger than said width of said hook, wherein said saddle includes a central raised portion; and a pair of opposed frusto-conical bumper pads axially aligned with said saddle.

2. A fitting for a synthetic web sling as set forth in claim 1 wherein each said frusto-conical bumper pad has a small diameter and a large diameter, each said large diameter larger than said diameter of said arcuate surface of said saddle.

3. A fitting for a synthetic web sling as set forth in claim 2 wherein said web sling has a given thickness and wherein the difference between said conical bumper pad large diameters and said arcuate surface diameter is greater than said sling thickness.

4. A fitting for a synthetic web sling as set forth in claim 1 wherein said frusto-conical bumper pads laterally align said web sling on said saddle.

5. A fitting for a synthetic web sling as set forth in claim 1 wherein said spool is parallel to said saddle of said hook.

* * * * *